US006663321B1

(12) United States Patent
Bisschops

(10) Patent No.: US 6,663,321 B1
(45) Date of Patent: Dec. 16, 2003

(54) PROCESS AND DEVICE FOR PRODUCING A PILE IN THE EARTH

(75) Inventor: Adrianus Theodorus Maria Bisschops, Leiderdorp (NL)

(73) Assignee: Voorbij Groep B.V., Uithoorn (NL)

( * ) Notice: Subject to any disclaimer, the term of this patent is extended or adjusted under 35 U.S.C. 154(b) by 0 days.

(21) Appl. No.: 09/980,565

(22) PCT Filed: Jun. 5, 2000

(86) PCT No.: PCT/NL00/00379

§ 371 (c)(1),
(2), (4) Date: Dec. 4, 2001

(87) PCT Pub. No.: WO00/75436

PCT Pub. Date: Dec. 14, 2000

(30) Foreign Application Priority Data

Jun. 4, 1999 (NL) ..... 1012243

(51) Int. Cl.[7] ..... E02D 5/34; E02D 11/00; E02D 15/04

(52) U.S. Cl. ..... 405/232; 405/50; 405/240; 405/256; 175/20; 175/323

(58) Field of Search ..... 405/50, 232, 233, 405/236, 240–242, 239, 248, 256; 175/20, 171, 323, 394; 52/155, 157, 158, 169.13, 705, 707

(56) References Cited

U.S. PATENT DOCUMENTS

| | | | | | |
|---|---|---|---|---|---|
| 3,270,511 | A | * | 9/1966 | Colle | 405/237 |
| 3,300,988 | A | * | 1/1967 | Phares et al. | 405/233 X |
| 3,303,656 | A | * | 2/1967 | Landau | 405/50 |
| 3,485,052 | A | * | 12/1969 | Turzillo | 175/394 X |
| 3,608,317 | A | * | 9/1971 | Landau | 405/236 |
| 3,707,848 | A | * | 1/1973 | Chelminski | 405/240 X |
| 3,772,894 | A | * | 11/1973 | Godley et al. | 405/50 |
| 3,808,823 | A | * | 5/1974 | Chelminski | 405/271 |
| 3,907,042 | A | * | 9/1975 | Halwas et al. | 173/160 |
| 3,962,879 | A | * | 6/1976 | Turzillo | 405/236 |
| 4,023,325 | A | * | 5/1977 | Paverman | 52/741.14 |
| 4,152,089 | A | * | 5/1979 | Stannard | 405/242 |
| 4,269,544 | A | * | 5/1981 | Rusche | 405/233 X |
| 4,311,416 | A | * | 1/1982 | Rusche | 405/232 |
| 4,433,943 | A | * | 2/1984 | Pao Chen | 405/241 |
| 4,832,535 | A | * | 5/1989 | Crambes | 405/241 X |
| 4,981,393 | A | * | 1/1991 | van de Velde et al. | 405/232 X |
| 5,117,925 | A | * | 6/1992 | White | 405/232 X |
| 5,542,786 | A | * | 8/1996 | Blum | 405/240 |
| 5,697,733 | A | * | 12/1997 | Marsh, Jr. | 405/233 |
| 6,033,152 | A | * | 3/2000 | Blum | 405/241 |
| 6,039,508 | A | * | 3/2000 | White | 405/232 |
| 6,283,231 | B1 | * | 9/2001 | Coelus | 175/323 |
| 6,368,021 | B1 | * | 4/2002 | Strong et al. | 405/232 X |

FOREIGN PATENT DOCUMENTS

| | | | | |
|---|---|---|---|---|
| DE | 3243784 | * | 5/1984 | |
| DE | 3612437 | * | 10/1987 | |
| DE | 19740800 | * | 3/1999 | |
| FR | 1595633 | * | 7/1970 | |
| FR | 2681350 | * | 3/1993 | |
| GB | 1123953 | * | 8/1968 | |
| JP | 55119817 | * | 9/1980 | |
| JP | 60080619 | * | 5/1985 | |
| JP | 6136745 | * | 5/1994 | 405/233 |
| WO | 9316236 | * | 8/1993 | |

* cited by examiner

*Primary Examiner*—Jong-Suk (James) Lee
(74) *Attorney, Agent, or Firm*—Sughrue Mion, PLLC

(57) ABSTRACT

A process for producing a pile in the earth with a pipe is provided. The pipe is provided internally with a conduit, which emerges on the bottom side of the pipe, for feeding pile-forming, hardening material into the earth. The pipe is introduced into the earth, and the pipe is removed from the earth while a space created by the removal of the pipe is simultaneously filled with the pipe-forming, hardening material.

18 Claims, 3 Drawing Sheets

1
2
3
4
5
6
7
8
9
10
11
12
21
25

PROCESS AND DEVICE FOR PRODUCING A PILE IN THE EARTH

BACKGROUND OF THE INVENTION

The present invention is directed to a process for producing a pile in the earth with a pipe, the pipe being provided internally with a conduit, which emerges on the bottom side of the pipe, for feeding pile-forming, hardening material into the earth, the process comprising the introduction of the pipe into the earth, the removal of said pipe from the earth and, as the pipe is withdrawn, the filling of the space thus created with the pile-forming, hardening material.

DESCRIPTION OF THE RELATED ART

In the prior art, numerous processes are known for the making of piles. A distinction must be drawn between reinforced and non-reinforced piles. For the production of reinforced piles, all sorts of pipe constructions are brought into the earth and, once the desired depth has been reached, the reinforcement is put in place and concrete poured or vice versa. The production of such concrete piles is a lengthy process which takes minutes to tens of minutes. Piles obtained in this way generally have a diameter greater than 20 cm. A known problem with such piles, especially with loose earth layers, is the risk of bulging as the pipe is vibrated or driven out, resulting from the difference in specific weight between the concrete and the surrounding earth. Vibration or shaking of the pipe as it is removed is necessary for the compaction of the concrete.

On the other hand, it is known to produce so-called foam concrete piles in the earth. A steel pipe is first placed in the soil down to the bearing layer, after which a plastics pipe may be placed therein which is subsequently filled with foam concrete, after which the steel pipe is removed. No reinforcement is used. Foam concrete of relatively low specific weight is used to combat the bulging effect.

The piles which are provided with reinforcements, which piles are known from the prior art, have a high bearing capacity. The structures lying thereon are of relatively heavy construction so as to bridge the large distance between the different piles of high bearing capacity. Foam concrete piles are often used to stabilize the earth. For foundation applications, these are not suitable.

A process for producing a pile in the earth with a pipe is know from WO 93/16236. The process which is known herefrom comprises in sequence the following steps: the driving into the earth of a pipe having a closed pointed end, the lowering of a reinforcement into the driven-in pipe, the filling of the pipe driven into the earth and the withdrawal of this pipe from the earth only after the pipe has been filled, the pointed bottom end of the pipe being able to swing open so as to leave the pile-forming material behind in the earth. The pipes in question have a diameter between 150 and 300 mm.

DE 3612437 discloses a pipe being introduced in the soil by vibration. Centrally a tube is provided. Before introduction the open end of the tube at the extrimity of the pipe is closed off by a cup shaped cover and at reachting the lowest point of introduction of the pipe followed by retraction cover 8 remains at the lower end of the hole so that the pipe becomes opened. A similar closing off and opening mechanism for concrete material to be pumped through a pipe is shown in U.S. Pat. No. 4,152,089 wherein a penetration plate 42 is pushed in advance of a pipe introduced in the soil and remains at the lower end of the bore provided.

SUMMARY OF THE INVENTION

The object of the present invention is to provide a process for producing a pile in the earth, which process can be realized relatively quickly. That is to say the number of maneuvers needed to arrive at the pile should be kept to an absolute minimum, thereby enabling a large number of piles to be put in place in one day, whereby hitherto used foundation methods can be substantially improved.

This object is achieved in the above-described process in that the conduit, as the pipe is introduced into the earth, is closed off on the bottom side of the pipe by means of a shut-off valve and is full of pile-forming material, and in that, immediately after this pipe reaches its lowest point, the shut-off valve is opened and the pile-forming material is pumped via the conduit, as the pipe is withdrawn, into the underlying space which is thereby created, and that the formed pile has a diameter less than 25 cm, such as 20 cm, and that the pumped pile-forming material contains no solid constituents of more than 16 mm in diameter.

Preferably, the pipe is moved down to the bearing layer and not introduced into the bearing layer as is customary with driven piles and the like. The pile can also however be moved down into the bearing layer. The pile according to the invention has a relatively small diameter-and a correspondingly low bearing capacity. As an example, a value between 10 and 15 tonnes is given compared to 50–200 tonnes for conventional driven piles. In the piles according to the invention, it is not however necessary to apply a reinforcement. However, a reinforcement can very easily be provided, for example a reinforcement of fibres, for example steel fibres, mixed into the pile-forming material. Work can proceed especially quickly, because at the instant at which the pipe reaches the lowest point it is immediately withdrawn again, whereupon the opening which is left is directly filled with the pile-forming material. This pile-forming material can be any material known in the prior art, but it is essential that it compacting concrete mortar. These mortars consist of a mixture of cement, fly ash or other fine parts and water. The liquid mortar can have a strength classification which is known in the prior art, for example B15 or B25. Liquid mortar does not need to be compacted, thereby obviating the need to shake or vibrate the pipe as it is lifted, as well as preventing bulging.

The fact that the conduit is already full of pile-forming material as the pipe is introduced into the earth means that, as soon as the lowest point is reached, the pipe can start to be withdrawn and, at the same time, the space vacated as the pipe withdraws can start to be filled with pile-forming material. When the lowest point is reached, the pipe is therefore already full to the bottom with pile-forming, hardening material, thereby allowing an extra filling step to be omitted, so that a considerable time saving is achieved through the direct withdrawal of the pipe and the immediate filling of the space in the earth.

It has been shown that the pile according to the invention can be produced within 1 minute. During the first 30 seconds of this minute, the pipe is moved downwards and during the following 30 seconds the pipe is withdrawn as the cavity created is filled with the pile-forming material. Directly after the removal of the pipe, a reinforcement bar or some reinforcement might possibly be applied. The piles made with the invention are relatively short and are generally less than 15 metres in length, though piles of up to 25 meters in length are also conceivable.

The pipe can be introduced in any way which is known in the prior art. Preference is given to vibration and more especially to high-frequency vibration. High-frequency vibration has been shown reliably to prevent damage to surrounding structures. Moreover, it is possible to move especially quickly with the pipe through soft layers of earth.

The pipe can be closed off in any way during the downward motion, the shut-off valve being preferably located close to the bottom side of the pipe, so that the pipe is already filled with pile-forming material. This increases the speed of the process and at the same time prevents air having to be forced out of the pipe as the pile-forming material is introduced. This can be achieved with a valve disc which is known in the prior art and which is clamped on the front of the pipe. Once the lowest point has been reached and the pipe withdrawn, such a disc is left in the earth. It is also possible to reduce this disc to a plug which is fitted to the outlet opening of the conduit for the pile-forming material. All this is dependent upon the design of the closure for the pile-forming material. This can be a grid valve consisting of two plates sliding one over the other, each provided with openings, where in a first position these openings are situated in line and in the second position these openings cover each other to form a seal. This is an especially simple shut-off valve which can easily be operated from ground level. Other shut-off valves are also possible however. As an example, a so-called tube valve is cited. This is a shut-off valve in which part of the passage is delimited by a flexible wall surrounded by an annular chamber. Through the introduction of (air) pressure into such a chamber, the parts of the flexible wall are forced one against the other and the passage is closed. A shut-off valve of this type has the advantage over the above-described grid valve that when it is open a relatively large passageway is present. This is of benefit in connection with cleaning and installation of the above-stated plug. It is also possible to use ball valves, in which case the above-described base comprises a conical part which closes off the bottom side of the pipe to be placed in the earth. When the lowest point is reached, the base is disconnected and the pipe moves away from the cone, after which material transport can immediately take place. As indicated above, the invention allows a pile to be produced especially quickly. It is thereby possible fully to revise foundation methods. According to the invention, it is no longer proposed to use a limited number of high-load-bearing piles with a heavy structure on top, but rather it is proposed to provide a large number of piles according to the invention on a relatively small surface area. It is consequently no longer necessary to place a heavy structure on the piles, since the weight placed on a floor or the like is transmitted evenly into the earth as a result of the large number of piles. According to an advantageous embodiment of the invention, at least 5 piles per 10 $m^2$ and according to a preferred embodiment at least one pile per $m^2$ are present in such a structure. As a result of the fast way of making the piles, considerable savings are shown to accrue by comparison with the prior art. These savings apply to the provision of the piles according to the invention compared with piles according to the prior art. Added to this is the benefit of the lighter construction which is allowed by the use of a large number of piles.

With the invention, any sort of foundation is obtainable. Floors of commercial buildings are herein envisaged, though bodies of dykes, roadbeds, etc. are also envisaged.

Because the diameter of the pile made according to the invention is less than 25 cm, the diameter of the pipe which is placed in the earth will also be less than 25 cm. The pump for pumping the material from which the pile is made can be any pump which is known in the prior art but preferably comprises a hose pump. Apart from the reliability thereof, this has the advantage that the quantity of material which is metered per revolution is accurately known. In certain soil conditions, this is of importance. In such cases, it is essential that precisely the right quantity of material is introduced into the earth when the pipe is removed. If too little material is introduced, then a constriction arises in the pile to be made. If too much material is introduced, then an inadmissible thickening arises. By feeding the speed of withdrawal of the pipe to a computing device or the like, the pump speed is able to be controlled such that the volume which is left upon the withdrawal of the pipe is always perfectly regulated. This regulation can also, of course, work the other way round, that is to say that if the pump speed is constant the speed of withdrawal is controlled. A combination of the two is also possible. The pile-making process according to the invention is so simple that it can largely be automated. A device which drives the pipe into the earth can be accurately controlled by means of a GPS system. Since, apart from the vibration block, no other special structures are necessary, the device for introducing the pipes can be made in relatively light construction. This means that such a device can move over the building site without a large number of special measures having to be taken. It is in any event not necessary to erect on the building site heavy steel planking and the like, which planking results in hold-ups and logistical problems.

Since the piles realised with the above-described process have a limited bearing capacity, such as 10–15 tonnes per pile, compared with the piles known in the prior art, it is possible without many special measures to test these piles for strength after the material concerned has hardened. Indeed, based on a safety factor of 2, the strength of a pile can already easily be determined if an approximately 30-tonne load is applied. A 30-tonne weight can be relatively simply applied using a mobile installation, without resorting to tie piles or large reaction weights which are used in the testing of other piles.

Through the performance of such tests, the safety factor can also be adjusted downwards.

By withdrawing the pipe from the earth at a speed greater than 0.5 m/s, such as 0.67 m/s, the likelihood of so-called bulging of the pile to be formed is reduced. If the withdrawal speed is such, then a pile of relatively constant cross-sectional size is realizable. In particular, it is herein advantageous if the speed of withdrawal of the pipe is greater than 1 m/s. The so-called bulging of the pile to be formed can be further reduced according to the invention by withdrawing the pipe from the earth without it being vibrated.

In order to minimize bulging on the one hand and constriction of the pile to be formed on the other hand and to obtain a pile of the most constant possible cross-sectional shape, according to the invention it is advantageous if the pump capacity and/or the speed of withdrawal of the pipe is/are controlled such that the space which is created beneath the pipe upon its withdrawal is essentially immediately filled with the pile-forming, hardening material.

For the purpose of facilitating the introduction of the pipe into the earth, according to the invention it is advantageous if, as the pipe is placed in the earth, water is injected at high pressure into the earth beneath the pipe such that the earth beneath the pipe is fluidized.

According to the invention, the pipe can be brought into the earth by the application of a compression force to the pipe and/or by vibration of the pipe. The application of a compression force to the pipe in order to drive it into the earth is denoted indeed as "pull-down". It is especially advantageous in this context if the pipe is driven into the outermost top layer of the earth by the sole application of a compression force, this for the purpose of preventing vibrations in this top layer, which is generally relatively loose.

BRIEF DESCRIPTION OF THE DRAWINGS

The invention will be illustrated in greater detail below with reference to an illustrative embodiment shown in the drawings, in which.

DETAILED DESCRIPTION OF THE INVENTION

Figure 1:
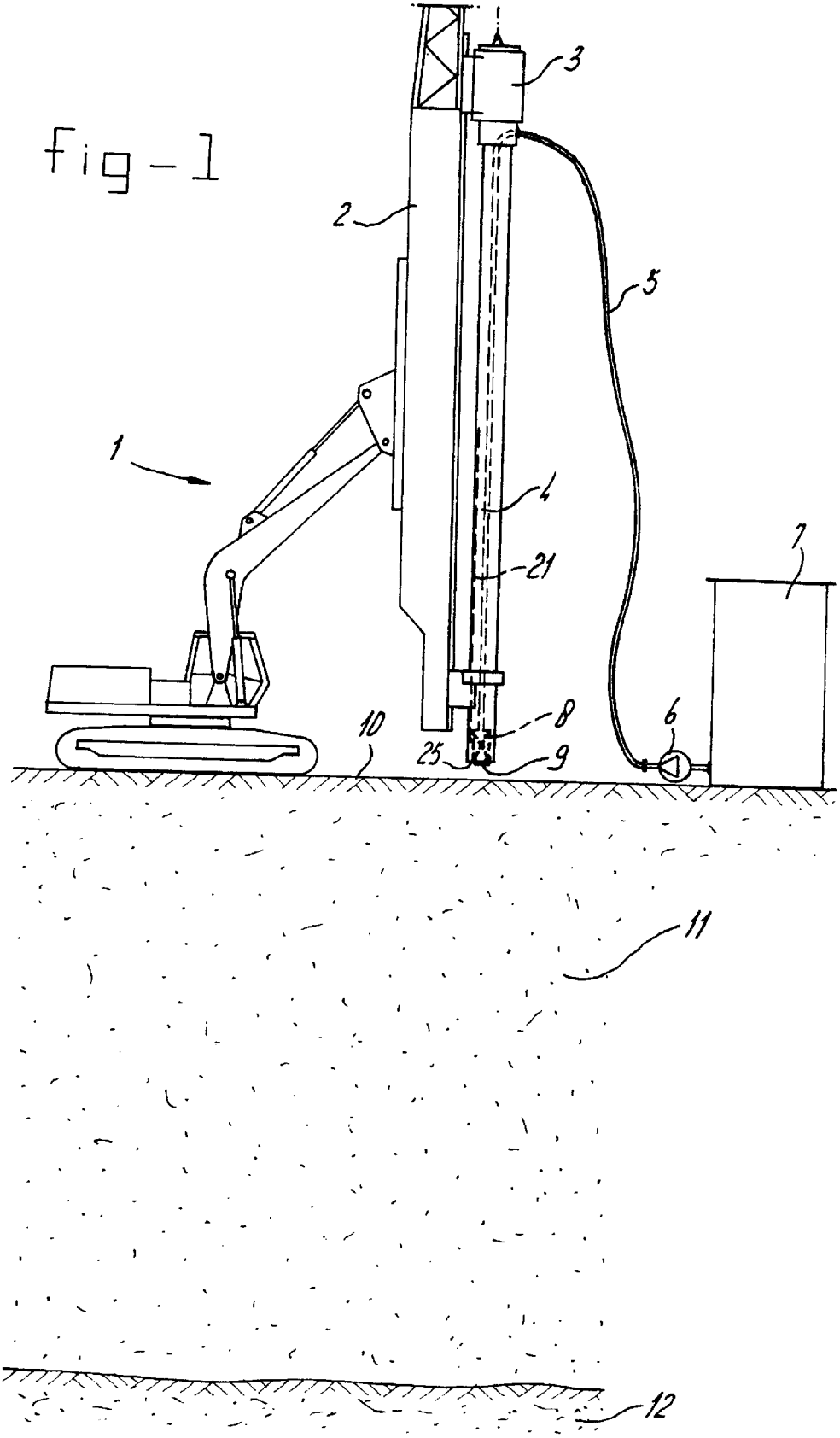
FIGS. 1–4 show four different steps for making a pile according to the invention.

In FIG. 1 a displaceable crane is denoted by 1. This is a relatively light crane provided with caterpillar tracks which can be driven over the majority of terrains without track shoes. The arm thereof is provided with a guide bar, which guides the pipe 4 in the vertical direction. Attached in a displaceable manner to the pipe 4 there is a high-frequency vibration block 3. In the crane there is a control system for displacement of a vibration block and for displacement of the crane itself. This can (partially) be automated. Positioning can be effected, for example, using the Global Positioning System, but any other positioning method which is known in the prior art, using laser, for example, can also be applied. In addition, a control system for operating a pump 6 (to be described below) is present in the crane.

Figure 2:
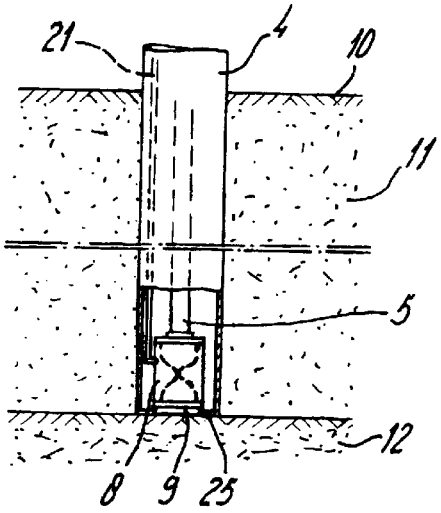

The ground level is denoted by 10 and beneath this there is a layer of earth material 11 which is relatively loose. Approximately 10 metres below this there is a load-bearing layer 12. The object of the invention is to provide a number of piles which extend through this earth layer 11 down to/into the layer 12. According to the invention, a pipe 4 is provided for this purpose. This is closed off on the bottom side by means of an end plate 25. In the end plate 25 a relatively large opening is made, closed off by a plug 9. To this end plate there has also been fitted a tube valve 8, which will be described with reference to FIG. 6. This is connected on the other side to a hose 5, which at least in the part extending beyond the pipe 4 is flexibly constructed and is connected to a hose pump 6. This is in turn connected to a store/mixing device 7. In FIG. 1, the situation is shown prior to the introduction of a pipe 4. In FIG. 2, the situation is shown in which the pipe 4 has reached the load-bearing layer 12, the crane 1 having been omitted. Shut-off valve 8 close to the bottom side of the base 5 is constantly in the closed position and plug 9 is driven for the end of the pipe 4.

Figure 3:
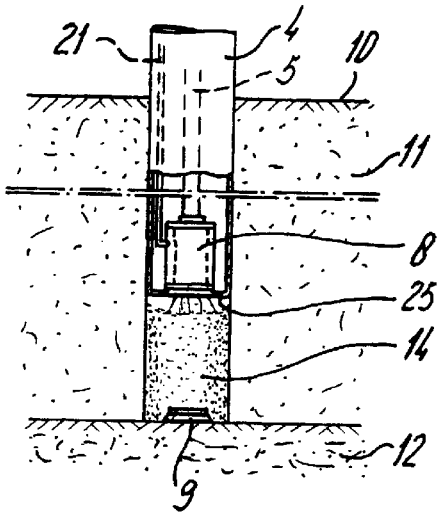

Once the load-bearing layer 12 is reached, the shut-off valve 8 is opened and the pipe 4 withdrawn simultaneously. The plug 9 is left behind on the load-bearing layer 12, as is shown in FIG. 3. That is to say, the load-bearing layer is not essentially entered. The withdrawal of the pipe 4 and the supply of material such as liquid mortar through the conduit 5 is effected in such a way that the space which is created by the withdrawal of the pipe 4 is essentially immediately filled with material, which in FIG. 3 is denoted by 14. All this is coordinated in such a way that this material is precisely sufficient to fill the space concerned but is no more or less, so that there is no possibility of constriction or bulging.

Figure 4:
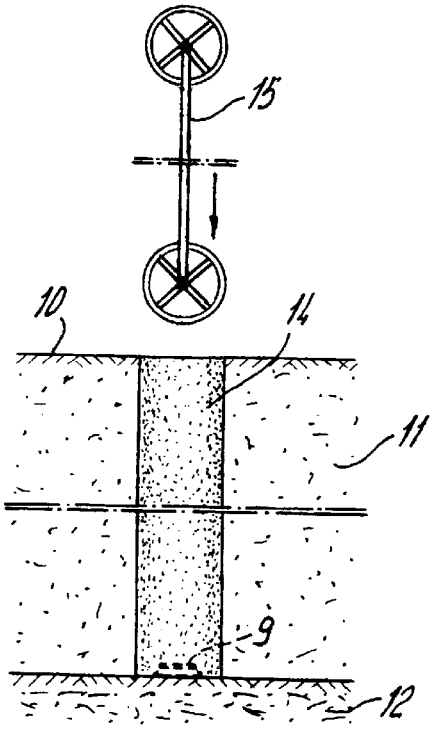

Following the complete withdrawal of the pipe, the condition results as shown in FIG. 4. Once the introduced material has hardened, the pile is basically ready. For certain applications, however, it is necessary to use a reinforcement. Following the removal of the pipe, this reinforcement can be introduced into the liquid mortar column. It can be seen from FIG. 4 that the reinforcement 15 which is shown there by way of example will extend over the full length of the pile and is provided close to the ends with spacers to ensure that the reinforcement is already situated in the middle of the formed, but not yet hardened pile. It is also possible, of course, to apply part-reinforcements.

The manoeuvres shown in FIGS. 1–3 can be carried out relatively quickly. In practical tests, it has already been shown that in approximately 15 seconds, if a vibration frequency of 40 Hz is used in the vibration block 3, the pipe 4 can be moved downwards over a distance of 10 metres in relatively soft earth. The following 15 seconds can be used for the withdrawal of the pipe without vibration or shaking. Since the material for the pile can be injected simultaneously, this entire operation can be realised in 30 seconds.

With the invention, one can set out to place a large number of piles on a small surface area. This means that, after one pile has been erected, the crane 1 has to cover a relatively short distance to make a following pile. Such a distance will typically be 1 metre. This scale of displacement can also be carried out in seconds, so that many tens of piles per hour can be realized. Because the material used to make the piles is a not uncommon liquid mortar, the material costs are low. The labour costs and machine costs are also low in view of the large number of piles which can be made per minute, whereby it is possible, assuming the same ultimate bearing capacity, to achieve a cost saving of at least 25% compared with traditional methods.

Figure 5:
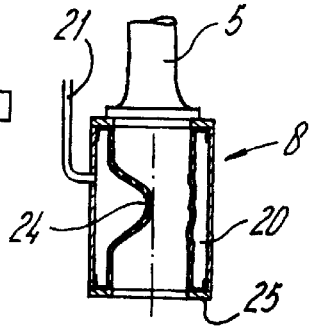
FIG. 5 shows a hose pump used in the device according to FIG. 1.

In FIG. 5, an example of a shut-off valve is shown which can be used at the end of a pipe 4. This is a tube valve. This comprises a flexible wall which connects to a conduit 5 and which on the left in FIG. 5 is shown in closed position and on the right in FIG. 5 in open position. This wall consists of a flexible material part 24 fitted in an annular chamber 20, which can be pressurized by means of a line 21. When the pressure is increased, the wall 24 moves towards the middle and brings about a closure. It will be understood that the increase in pressure in the conduit 5, for example when the pipe 4 reaches its lowest point, will give rise to a counter-pressure upon the shut-off valve, thereby promoting the opening of the latter. Consequently, it may even be possible to omit the control line 21 entirely. As a result of the medium used, pressure can be generated especially quickly by means of a pump 6, which is preferably constructed as a hose pump.

Figure 6:
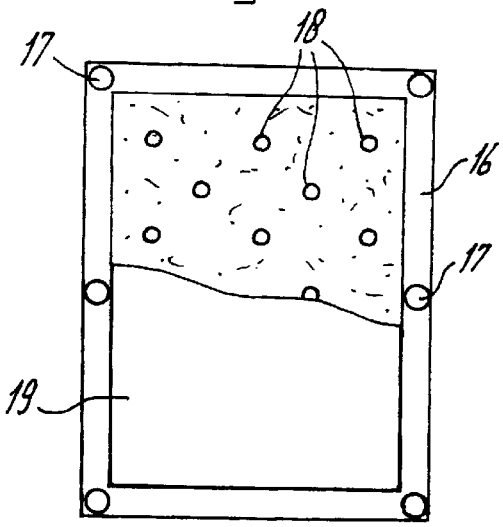
FIG. 6 shows a foundation made according to the invention.

In FIG. 6 an example is given of a foundation for, for example, a factory building, which comprises a conventionally made foundation edge 16, which is supported by means of conventional driven piles or otherwise made piles 17. The wall of the building can be placed on this edge and can support the roof.

According to the invention, the floor of such a building is made by the erection of a large number of piles 18 according to the invention, Preferably, 1 pile per $m^2$ is introduced using the above-described process. After this, a relatively thin layer of (reinforced) concrete is poured, which can serve as a floor and is denoted by 19. Such a construction is much lighter, whereby, apart from through savings in the foundation costs of piles 18, savings can additionally be made to the construction of the floor 19.

A further advantageous characteristic of the process is that, as a result of continuous recording of the used vibration energy and/or compression force during the introduction of the pipe in relation to the position of the pipe end in the earth, as well as the speed of descent of the pipe, a form of soil study can be effected and is applied to the pile to be made.

Figure 7:
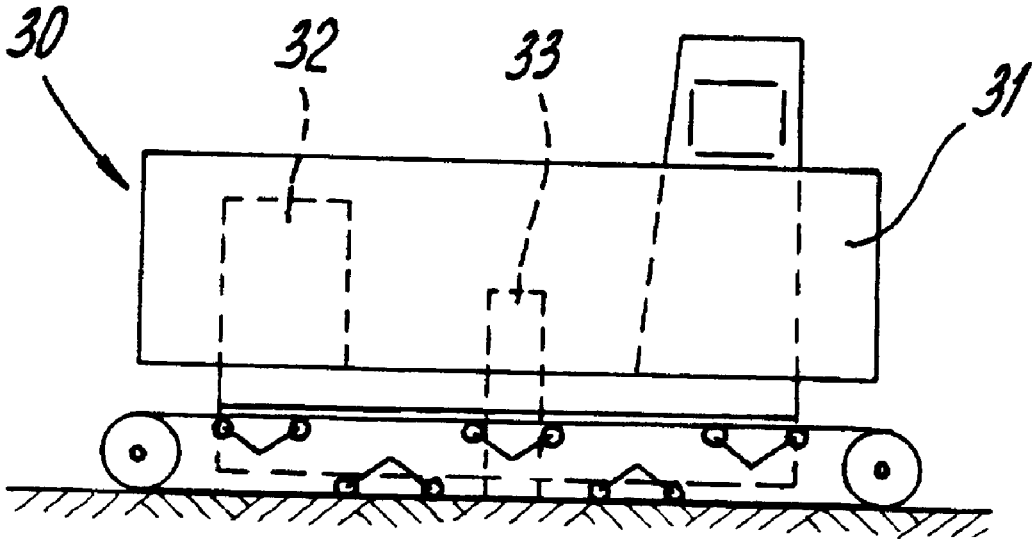
FIG. 7 shows diagrammatically a device for testing piles obtained by means of the invention.

In FIG. 7, a vehicle for subjecting the previously made piles to load is shown in diagrammatic representation, which vehicle is denoted in its entirety by 30. This is a caterpillar vehicle which can be moved on any terrain. This vehicle is provided on one side with a ballast tank 31 and on the rear side is provided with an engine 32, so that the centre of gravity lies approximately close to the middle, where a jack 33 is fitted.

The vehicle concerned moves to the position of the pile erected with the above-described process and then the jack is lowered onto this pile, whereupon the vehicle is forced more or less upwards. By adjustment of the weight in the ballast tank (filling with water), the weight of the vehicle is herein adjusted to the test weight.

Although the invention is described above with reference to a preferred embodiment, it will be clear to persons skilled in the art that many variants are possible which lie within the scope of the appended claims.

What is claimed is:

1. A process for producing a pile in the earth with the aid of a pipe, the pipe being provided internally with a conduit, which emerges on the bottom side of the pipe, for feeding pile-forming, hardening material into the earth, the process comprising:

introduction of introducing the pipe into the earth, removing the pipe from the earth and, as the pipe is being withdrawn, simultaneously filling an underlying space, created by the removing of the pipe, with the pile-forming, hardening material, wherein the conduit, as the pipe is introduced into the earth, is closed off on the bottom side of the pipe by means of a shut-off valve which is close to the bottom side of the conduit and operated from ground level, and is full of pile-forming, hardening material, said operation of the shut-off valve being independent from the presence of the pile-forming, hardening material, immediately after the pipe reaches its lowest point, the shut-off valve is opened from ground level and the pile-forming, hardening material is pumped via the conduit, as the pipe is withdrawn, into the underlying space which is thereby created, and that the formed pile has a diameter less than 25 cm, and that the pumped pile-forming, hardening material contains no solid constituents of more than 16 mm in diameter.

2. The process according to claim 1, wherein the introduction comprises vibrations of a frequency greater than 30 Hz.

3. The process according to claim 1, wherein, after the withdrawal of the pipe from the earth, a reinforcement is applied.

4. The process according to claim 1, wherein the pile-forming, hardening material comprises liquid mortar or self-compacting concrete mortar.

5. The process for making a foundation according to claim 1, comprising the making of a number of piles in the earth, the diameter of each of the piles being less than 25 cm and in that at least five piles are made per 10 $m^2$ of earth surface.

6. The process according to claim 1, wherein during the first no more than 30 seconds the pipe is introduced and in the following 30 seconds the pipe is removed as the pile-forming, hardening material is introduced.

7. The process according to claim 1, wherein, after the pile has been formed, a test load is applied thereto.

8. The process according to claim 1, wherein the removal of the pipe from the earth is effected by withdrawal at a speed greater than 0.5 m/s, such as 0.67 m/s.

9. The process according to claim 8, wherein the withdrawal of the pipe is effected without vibration thereof.

10. The process according to claim 1, wherein a pump capacity and a speed of withdrawal of the pipe are controlled such that the underlying space which is created beneath the pipe upon its withdrawal is essentially immediately filled with the pile-forming, hardening material.

11. The process according to claim 1, wherein, as the pipe is placed in the earth, water is injected at high pressure into the earth beneath the pipe.

12. The process according to claim 1, wherein the pipe is brought into the earth by the application of at least one of a compression force to the pipe or by vibration of the pipe.

13. The process according to claim 12, wherein the pipe is driven into the top layer of the earth solely by application of a compression force.

14. A device for making a pile in the earth, comprising a pipe to be placed in the earth and provided internally with a conduit for feeding a pile-forming, hardening material into the earth, wherein the conduit on one end is permanently provided in the pipe with a shut-off valve close to a bottom end of the pipe the shut-off valve, is operable from ground level, and on an other end is connected to a pump, and in that at least a part of the conduit which extends between the pipe and the pump is of flexible construction, wherein operation of the shut-off valve is provided at the ground level and independent of the presence of pile-forming, hardening material.

15. The device according to claim 14, wherein the pump comprises a hose pump.

16. The device according to one of claim 14, wherein the shut-off valve comprises a tube valve.

17. The device according to one of claim 14, wherein an outlet of the shut-off valve is arranged to receive a shut-off plug.

18. A process for making a construction, comprising making a peripheral edge made from concrete material and supported by driven, screw or other piles of more than 20 cm in diameter, erecting a number of foundation piles within the peripheral edge, pouring a concrete floor upon the foundation piles, wherein each pile is produced in the earth with the aid of a pipe, the pipe being provided internally with a conduit, which emerges on the bottom side of the pipe, for feeding pile-forming, hardening material into the earth, the process comprising:

introducing the pipe into the earth, having the conduit with the pile-forming, hardening material therein and a shut-off valve close to the bottom side of the end, removing the pipe from the earth and, as the pipe is withdrawn, filling a space thus created by the withdrawn pipe, with the pile-forming, hardening material, upon opening of the shut-off valve which is operated from ground level independent of the presence of the pile-forming, hardening material in the conduit.

* * * * *